United States Patent [19]

Miyamoto

[11] Patent Number: 4,993,385

[45] Date of Patent: Feb. 19, 1991

[54] DEVICE FOR CONTROLLING SPEED OF AN ENGINE

[75] Inventor: Yasuhiko Miyamoto, Tokyo, Japan

[73] Assignee: Fuji Jukogyo Kabushiki Kaisha, Tokyo, Japan

[21] Appl. No.: 502,623

[22] Filed: Apr. 2, 1990

[30] Foreign Application Priority Data

Apr. 4, 1989 [JP] Japan ..... 1-40252[U]

[51] Int. Cl.[5] ..... F02D 7/00

[52] U.S. Cl. ..... 123/400; 123/403

[58] Field of Search ..... 123/400, 403; 74/501.5, 74/501.6, 96, 107, 211, 522, 571 R, 571 M

[56] References Cited

U.S. PATENT DOCUMENTS

| | | | |
|---|---|---|---|
| 4,117,809 | 10/1978 | Kittler | 123/403 |
| 4,566,415 | 1/1986 | Iwai et al. | 123/361 |
| 4,860,608 | 8/1989 | Kobayashi | 123/400 |
| 4,860,708 | 8/1989 | Yamaguchi et al. | 123/399 |
| 4,950,965 | 8/1990 | Kenny et al. | 123/400 |

FOREIGN PATENT DOCUMENTS

| | | | |
|---|---|---|---|
| 0030432 | 2/1985 | Japan | 123/400 |
| 62-56752 | 4/1987 | Japan | 123/400 |
| 62-110558 | 7/1987 | Japan | 123/400 |
| 62-116154 | 7/1987 | Japan | 123/400 |

*Primary Examiner*—Raymond A. Nelli

*Attorney, Agent, or Firm*—Beveridge, DeGrandi & Weilacher

[57] ABSTRACT

In a carburetor of a motor vehicle engine having an accelerating pump for supplying additional fuel when an accelerator pedal is depressed to a large extent, the accelerator pedal is connected to a slider which is connected through an accelerating pump cable to a swing arm for actuating the accelerating pump via a link and a lever. The slider is connected also to a throttle lever through a throttle cable. The throttle lever is coupled to a throttle shaft of a throttle valve by means of a torsion spring. When the accelerator pedal is depressed, the throttle cable and the accelerating pump cable are pulled, and the control lever is turned to rotate the throttle shaft by way of the spring in a direction toward an open position of the throttling valve so that the engine is accelerated, while the accelerating fuel pump is operated through the swing arm, the link and the lever so that an increased amount of fuel is supplied by the pump. Since the throttle valve and the accelerating pump are operated separately by way of the respective cables, the throttle shaft can be rotated with a small torque and the speed control can be carried out exactly without delay.

4 Claims, 6 Drawing Sheets

DEVICE FOR CONTROLLING SPEED OF AN ENGINE

BACKGROUND OF THE INVENTION

The present invention relates to a device for controlling the speed of an engine, and, more particularly, to a device for controlling the engine speed with an improved response.

As is well known in the art, an engine mounted on a motor vehicle has a carburetor. The carburetor has a throttle valve with a throttle shaft which rotates in response to depression of an accelerator pedal to control the amount of air fuel mixture supplied to the engine.

The carburetor is provided with an accelerating pump for increasing fuel supply to the engine when the accelerator pedal is depressed to a large extent. The accelerating pump has an adjusting rod. The adjusting rod is coupled to the throttle shaft through a lever mechanism, as disclosed in Japanese Utility Model Laid Open Nos. 62-56752, 62-110558 and 62-116154. When the throttle shaft is rotated, the rotation is transmitted to the adjusting rod through the lever mechanism to displace the rod longitudinally, and the rod causes a piston to slide for increasing the amount of fuel supplied to the engine by means of the accelerating pump.

However, a relatively large torque is required for rotating the throttle shaft because of the mechanical connection of the accelerating pump to the throttle valve.

On the other hand, the engines of recent motor vehicles are installed with an engine speed control device. The engine speed control device is typically in the form of a governor device having governor weights which swing or expand radially outwardly for maintaining a predetermined vehicle speed, to cause a governor lever to swing so as to rotate the throttle shaft in a direction toward a close position of the throttle valve. Consequently, the vehicle speed does not exceed 105 Km/h, for example, in the case of a small motor vehicle.

As mentioned above, a relatively large torque is required for rotating the throttle shaft in the known devices, wherefore there occurs a delay in the response of the engine speed control device together with deviation of the maximum vehicle speed at which the throttle shaft is rotated in a direction toward the close position of the throttle valve.

SUMMARY OF THE INVENTION

It is an object of the present invention to eliminate the problems stated above and to provide a device for controlling the speed of an engine in which the engine speed control device can rotate the throttle shaft with a smaller torque than in the known devices so as to respond rapidly without delay and deviation in rotating the throttle shaft.

According to the present invention, the above object is attained by providing a device for controlling the speed of an engine having an accelerator, a carburetor with a throttle valve operatively connected to a rotatable throttle shaft and an accelerating pump for supplying additional fuel to the engine, and means for governing the speed of the engine, comprising: connecting means for connecting the accelerator to the throttle shaft and the accelerating fuel pump, respectively, to operate the shaft and the pump separately responsive to the operation of the accelerator.

A preferred embodiment of the present invention will become understood from the following detailed description referring to the accompanying drawings.

DETAILED DESCRIPTION OF THE PREFERRED EMBODIMENT

Figure 5:
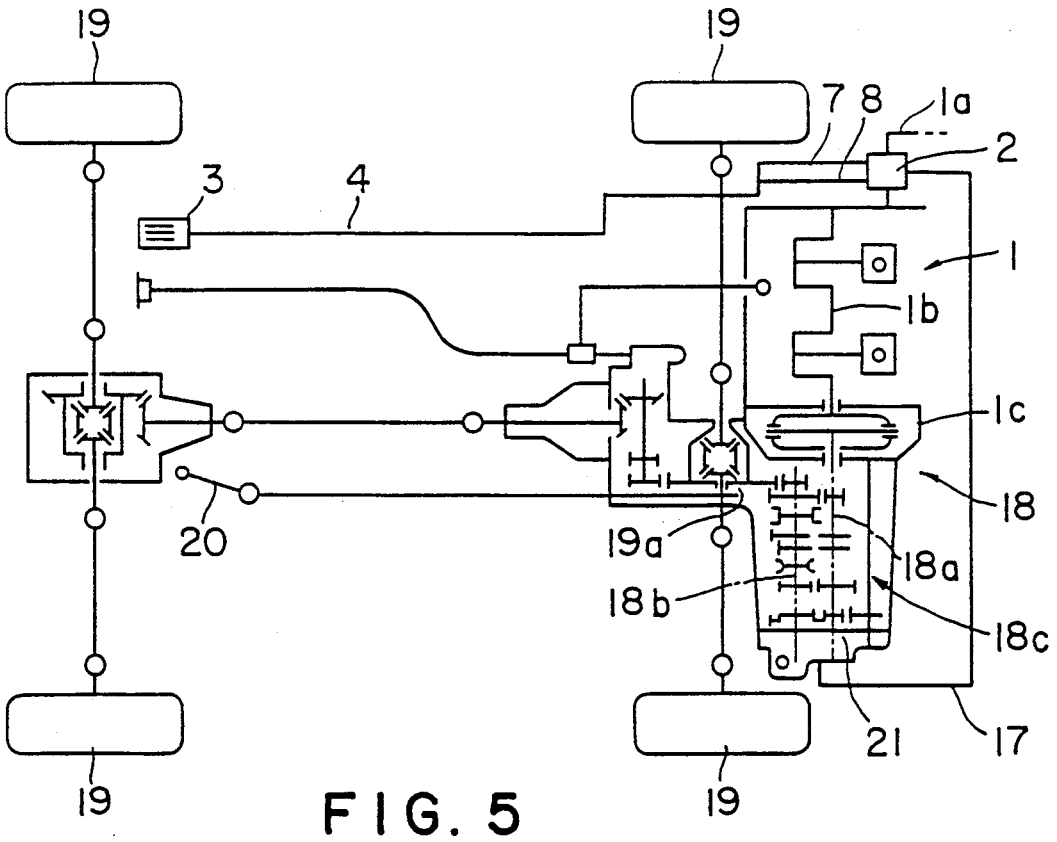
FIG. 5 is a diagrammatic plan view of a driving system of a motor vehicle.

Referring first to FIG. 5, an intake pipe 1*a* of an engine 1 has a carburetor 2 operatively coupled to an accelerator such as an accelerator pedal 3.

Figure 1:
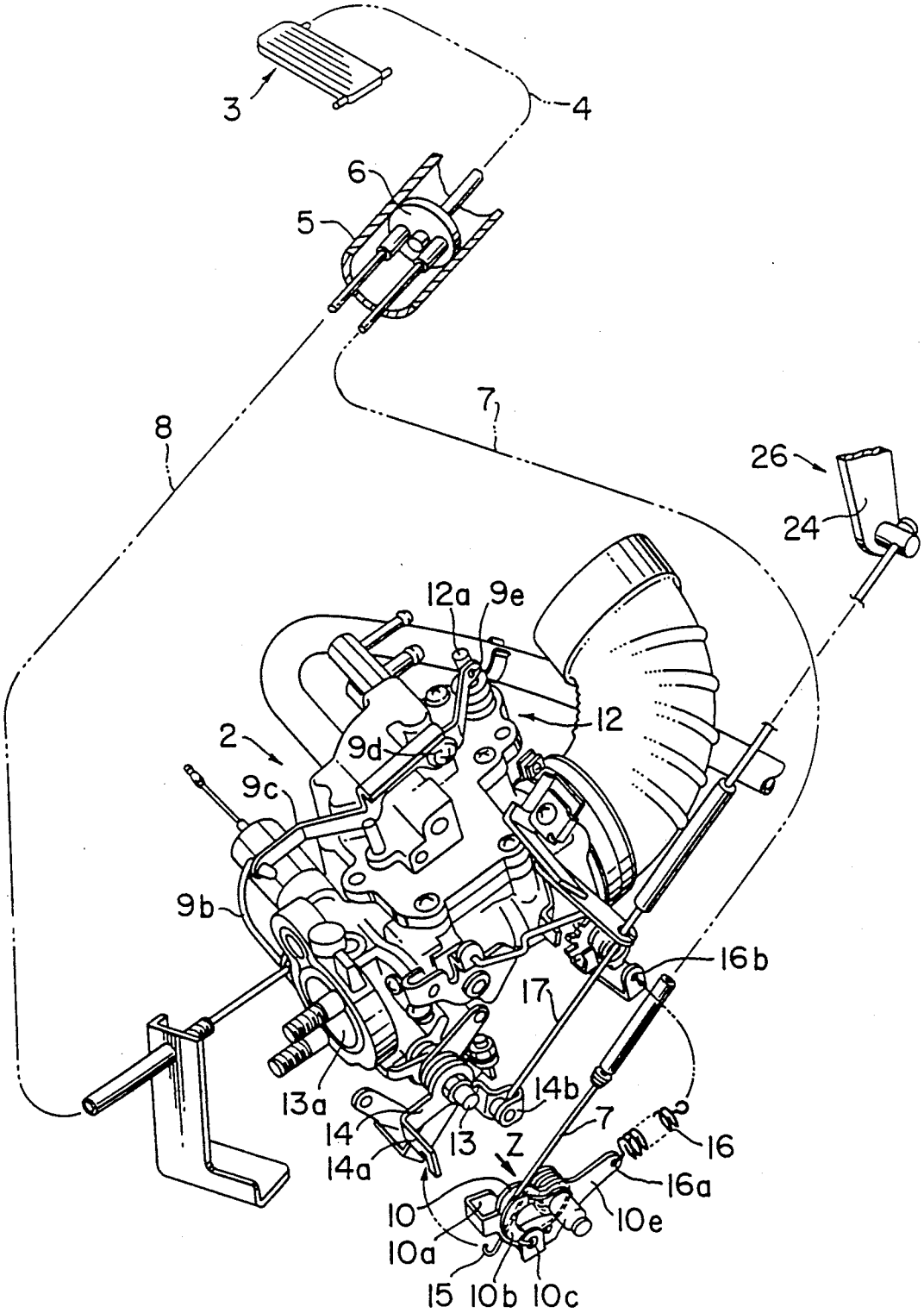
FIG. 1 is a diagrammatic perspective view showing a device for controlling speed of an engine according to the present invention.

As shown in FIG. 1, the accelerator pedal 3 is connected to one end of an accelerator cable 4, and the other end of the cable 4 is fixedly coupled to a slider 6 which is slidable in a guide cylinder 5 mounted on a motor vehicle. The respective ends of a throttle cable 7 and an accelerator pump cable 8 are fixedly connected to the slider 6.

Figure 2:
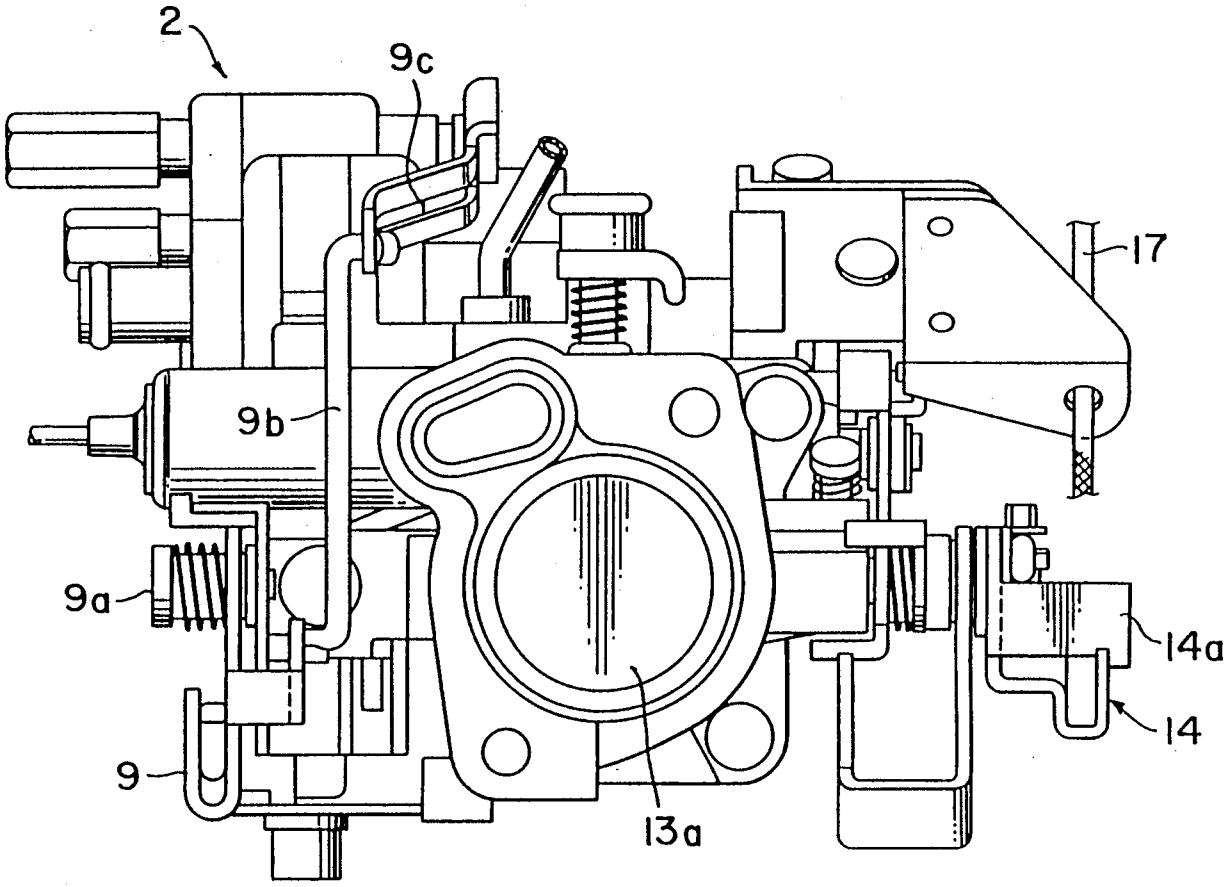
FIG. 2 is a left side view of a carburetor shown in FIG. 1.
Figure 4A:
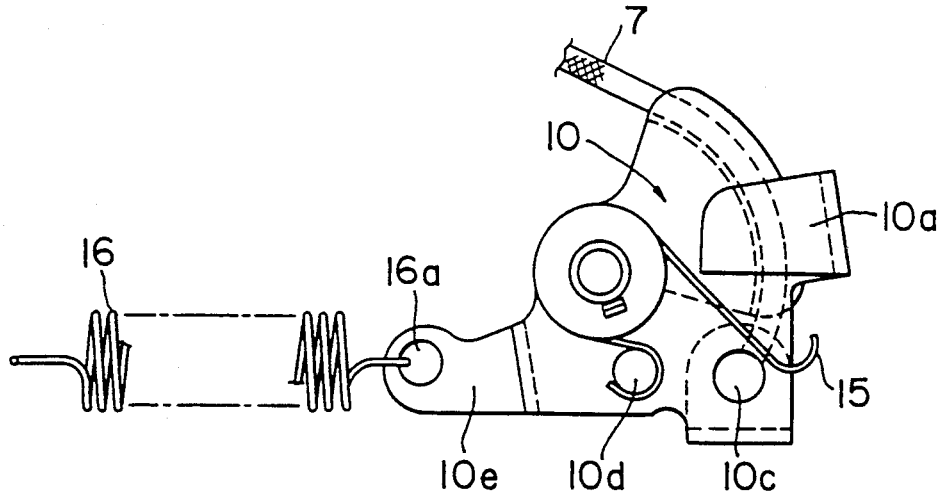
FIG. 4A is a view as seen in the direction of arrow Z in FIG. 1.
Figure 4B:
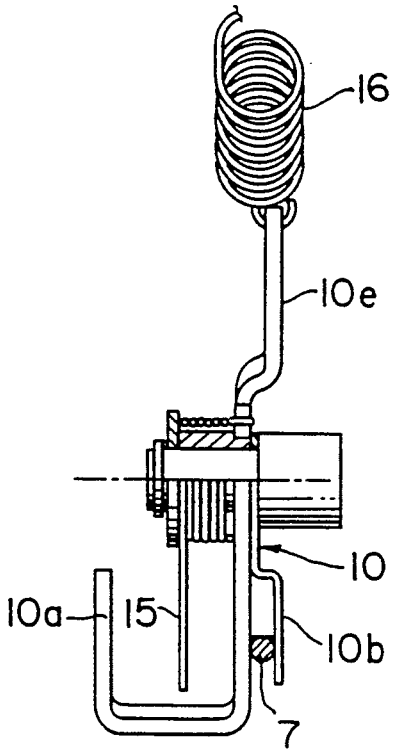
FIG. 4B is a plan view of FIG. 4A.

The throttle cable 7 and the accelerator pump cable 8 extend to the carburetor 2. The cable 8 is connected at the opposite end thereof to a swing arm 9 (FIG. 2), which is pivotally supported on one side of the body of the carburetor 2 by means of a pivot pin 9*a*. The opposite end of the throttle cable 7 is coupled to a throttle lever 10 swingably mounted on the opposite side of the carburetor body. The throttle cable 7 extends along a guide 10*b* (FIG. 4B) formed on the throttle lever 10. The end of the cable 7 is coupled to the throttle lever 10 by means of a fitting hole 10*c* as shown in FIG. 4A.

Figure 3:
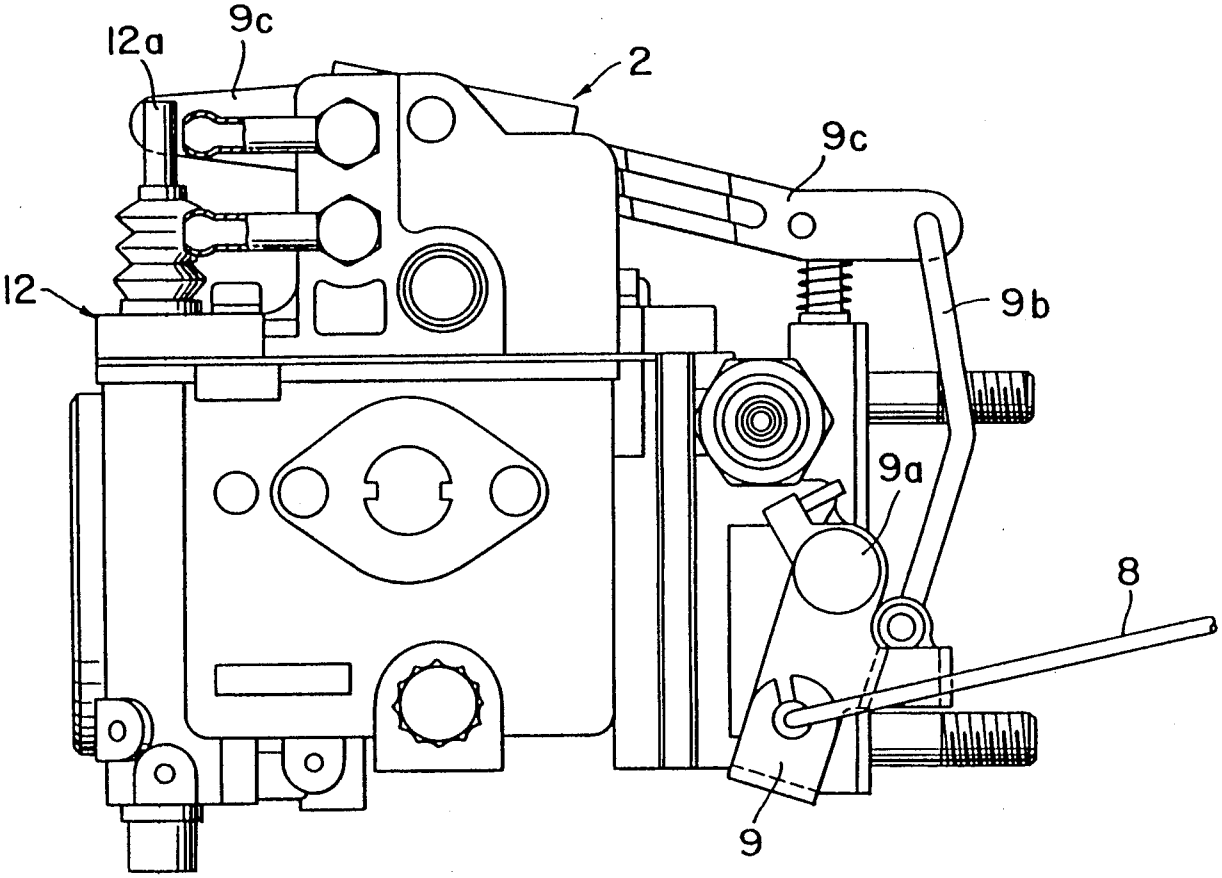
FIG. 3 is a rear view of the carburetor.

An accelerating pump 12 is fixedly provided adjacent to the carburetor 2 as shown. As shown in FIG. 1, the swing arm 9 is linked to an adjusting rod 12*a* of the accelerating pump 12 through a link 9*b* and a lever 9*c*. One end of the link 9*b* is joined to the swing arm 9 as shown in FIG. 3, and the other end of the link 9*b* is pivotally connected to one end of the lever 9*c*.

As shown in FIG. 1, the lever 9*c* is pivoted by a pin 9*d* to the body of the carburetor 2. The other end of the lever 9*c* is pivotally connected at 9*e* to the adjusting rod 12*a*. When the accelerator pedal 3 is depressed, the amount of fuel supplied to a venturi tube of the carburetor 2 is increased according to the degree of the depression.

As indicated in FIG. 1, the throttle lever 10 is freely rotatably fitted on a throttle shaft 13 to which a known throttle valve 13*a* in the form of a butterfly valve is secured. A control lever 14 is securely mounted on the throttle shaft 13 so as to rotate with the throttle shaft 13. A stopper 10*a* (FIGS. 4A and 4B) of the throttle lever 10 is disposed above the control lever 14. One end of a coiled torsion spring 15, which is mounted on the throttle shaft 13, is engaged with a pin 10*d* of the throttle lever 10, and the other end of the spring 15 is engaged with an angularly bent tip part 14*a* of the control lever 14, so that angular movement of the throttle lever 10 may be transmitted to the control lever 14 through the spring 15. More specifically, when the accelerator pedal 3 is depressed to pull the throttle cable 7, the throttle lever 10 is rotated to transmit clockwise rotation as viewed in FIG. 1 to the control lever 14 via the spring 15 so as to rotate the throttle shaft 13 toward a fully open position of the throttle valve 13*a*.

One end of a return coil spring 16 is anchored at 16*a* to an extension 10*e* throttle lever 10, extending in a direction different from the main part of the throttle lever 10, as shown in FIGS. 1 and 4A. The other end of the return spring 16 is anchored at 16*b* (FIG. 1) to a stationary bracket. As a result, the throttle lever 10 is resiliently urged in an angular direction counter to the direction in which the throttle lever 10 is rotated by the pulling force of the throttle cable 7.

As shown in FIG. 1, the control lever 14 has an integral extension 14*b* projecting in a direction opposite to the bent tip part 14*a*, and a governor cable 17 is anchored at one end thereof to the extension 14*b*. The other end of the governor cable 17 extends toward the engine 1.

As shown in FIG. 5, a transmission 18 is connected to the engine 1 in such a manner that an input shaft 18*a* of the transmission may be coupled to a crankshaft 1*b* of the engine 1 through a clutch 1*c*.

An output shaft 18*b* of the transmission 4 extends in parallel with the input shaft 18*a* in the transmission 4. The output shaft 18*b* and the input shaft 18*a* are drivingly coupled to each other through a plurality of transmission gears 18*c* which can be meshed with each other in different combinations by a shift lever 20 disposed adjacent to a driver's seat. The output shaft 18*b* is drivingly coupled to driving wheels 19 of the motor vehicle through output gears 19*a*.

Figure 8:
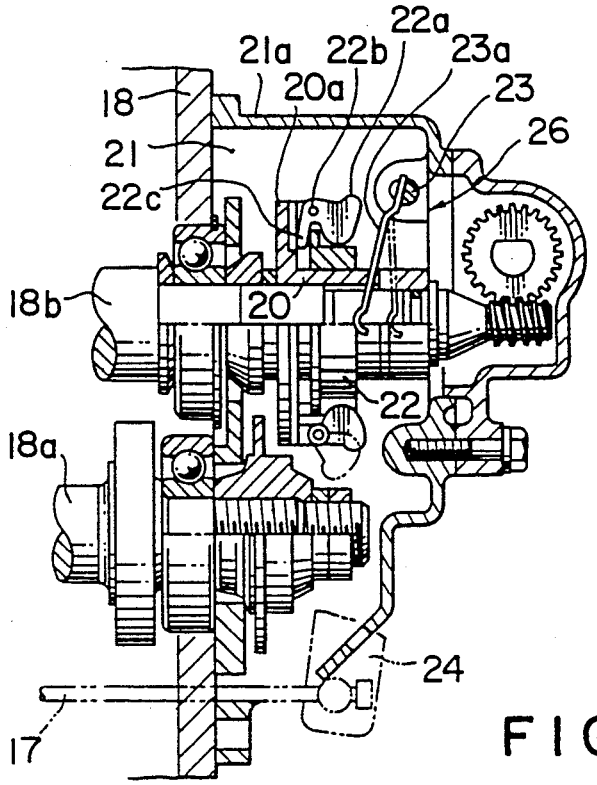
FIG. 8 is a sectional view taken along the line VIII—VIII of FIG. 7.

Referring next to FIG. 8, a governor chamber 21 defined by a cover 21*a* is provided in one side of the transmission 18, and one end of the output shaft 18*b* extends into the governor chamber 21 and slidably carries thereon a governor sleeve 22. A bush 20 is fixedly mounted on the output shaft 18*b* and the sleeve 22 is slidable thereon. A plurality of governor weights 22*a* are provided for shifting the governor sleeve 22. Each governor weight 22*a* is pivoted with a pivot pin 22*b* to an annular flange 20*b* of the bush 20. Therefore, when the rotational speed of the driving wheels 19 reaches a speed corresponding to, for instance, a speed of 105 Km/hr, each weight 22*a* is rotated by centrifugal force about the pivot pin 22*b* radially outwardly, so that an arm 22*c* of each weight 22*a* is axially pressed against the governor sleeve 22 which in turn is caused to slide in the rightward direction as viewed in FIG. 8 with respect to the output shaft 18*b*. The above described members constitutes a governor device 26.

Figure 7:
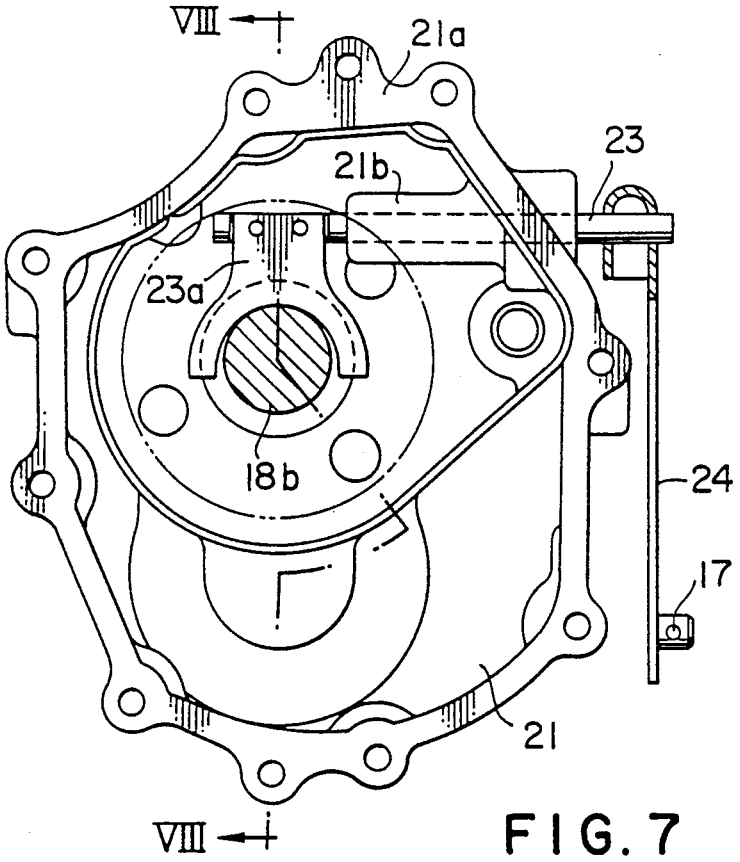
FIG. 7 is a view of a governor chamber, as seen from the inside of a transmission.

Referring also to FIG. 7, a governor shaft 23 extends rotatably through a boss 21*b* integrally extended inwardly from the cover 21*a* and securely carries at the inner end thereof the base end of a swing member 23*a*, which is in contact with the governor sleeve 20. It therefore follows that when the governor sleeve 20 is caused to slide to push the swing member 23*a* in the rightward direction as viewed in FIG. 8, the governor shaft 23 is rotated in a counterclockwise direction.

Figure 6:
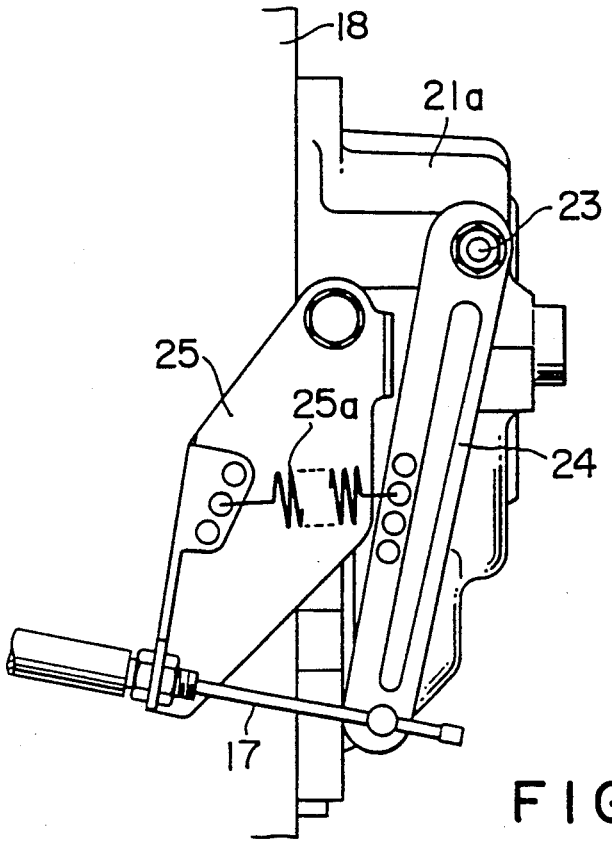
FIG. 6 is a side view of a governor.

One end of a governor lever 24 is securely fixed to the outer end of the governor shaft 23 extending beyond the governor chamber 21 while the other end of the governor lever 24 is securely attached to one end of the governor cable 17, as shown also in FIG. 6.

As best shown in FIG. 6, one end of a governor spring 25*a* is anchored to the governor lever 24 at an intermediate point between the ends thereof, while the other end of the governor spring 25*a* is anchored to a bracket 25 on the casing of the transmission 18.

The device for controlling the engine speed, as described above operates in the manner described below.

When the accelerator pedal 3 is depressed, the accelerator cable 4 is pulled so that the slider 6 is caused to slide in the guide cylinder 5.

Consequently, the throttle cable 7 and the accelerating fuel pump cable 8 are pulled by the slider 6, so that the swing arm 9 is swung about the pivot pin 9*a* in a counterclockwise direction as viewed in FIG. 3 while the throttle lever 10 rotates about the throttle shaft 13 in a clockwise direction as viewed in FIG. 1 against the force of the return spring 16.

The rotary movement of the throttle lever 10 is transmitted to the control lever 14 through the torsion spring 15, whereby the throttle shaft 13 fixedly carrying the control lever 14 is rotated in a direction toward an open position of the throttle valve so that the engine speed increases.

When the accelerator pedal 3 is depressed to a large extent, the swing arm 9 is swung accordingly, and the accelerating pump 12 is operated through the link 9*b*, the lever 9*c* and the adjusting rod 12*a*. That is, the adjusting rod 12*a* is so displaced in the longitudinal direction thereof as to increase the amount of fuel supplied to the engine 1 by the accelerating fuel pump 12.

When the engine speed thus increases, the rotational speed of the input shaft 18*a* of the transmission 18 also increases, and the increased speed of the shaft 18*a* causes an increase of the rotational speed of the wheels 19 via the transmission gears 18*c*, the output shaft 18*b* and the output gears 19*a*. When the transmission gears 18*c* are changed to a higher gear ratio by the shift lever 20, the speed of the wheels 19 is further increased.

When the rotational speed of the output shaft 18*b* increases to a value corresponding to a speed of 105 Km/h, for example, of the wheels 19, the centrifugal force produced by the rotation of the output shaft 18*b* causes the governor weights 22*a* to swing radially outwardly about the pin 22*b* to cause the governor sleeve 22 to slide in the rightward direction in FIG. 8.

Thereupon, the governor sleeve 22 causes the swinging member 23*a* to swing counterclockwise as viewed in FIG. 8 so that the governor shaft 23 is rotated in the same direction and therefore the rotating torque is produced by the governor lever 24. When the rotational speed of the output shaft 18*b* exceeds a predetermined rotational speed so that the governor weights 22*a* press against the governor sleeve 22, the rotating torque of the governor lever 24 increases and overcomes the force of the governor spring 25*a* whereby the governor lever 24 is rotated.

Thereupon, the governor cable 17 is pulled by the governor lever 24, and therefore the control lever 14 fixed to the throttle shaft 13 is rotated against the force of the torsion spring 15 in a direction counter to the direction in which the control lever 14 is urged by the spring 15 as a result of the depression of the accelerator pedal 3. As a consequence, the throttle shaft 13 is rotated by the control lever 14 in a direction to cause the throttle valve 13*a* to move toward a closed position thereof, independently of the degree of depression of the accelerator pedal 3. Therefore, the amount of fuel supplied to the engine 1 is reduced to cause decrease of the engine speed.

What resists the rotation of the throttle shaft 13 during the above operation is only the urging force of the torsion spring 15. Therefore, it is possible to rotate the throttle shaft 13 with a smaller torque than in the conventional device in which the accelerating fuel pump 12 is coupled to the throttle shaft 13. This means that the governor device 26 can operate without delay and can follow speed increase instantaneously and that there occurs no deviation of the highest vehicle speed at which the throttle shaft 13 is rotated toward the close position of the throttle valve. Consequently, the motor vehicle speed is prevented exactly from exceeding a set speed of 105 Km/h, for example.

When the vehicle slows down, the speed of the output shaft 18*b* coupled to the wheels 19 decreases, so that the centrifugal force acting on the governor weights 22*a* also decreases. Therefore, the governor lever 24 is returned by the force of the governor spring 25*a* since the rotating torque of the control lever 14 decreases. Consequently, the control lever 14 returns due to the force of the torsion spring 15 to a position corresponding to the degree of depression of the acceleration pedal 3.

While the embodiment of the present invention has been described as applied to a motor vehicle with a transmission coupled to the engine, the present invention may be applied to motor vehicles without a transmission or to general purpose engines.

Moreover, the accelerator and the engine speed control device are not limited to the accelerator pedal and the governor device of the type described above. Furthermore, the set maximum speed need not be limited to 105 Km/h.

It will be understood from the foregoing that the present invention is useful in that the throttle shaft can be rotated with a smaller torque than in the conventional devices since the throttle shaft is not coupled to the accelerating pump and that the engine speed control device can respond without delay and deviation in rotating the throttle shaft.

While the presently preferred embodiment of the present invention has been shown and described, it is to be understood that the disclosure is for the purpose of illustration and that various changes and modifications may be made without departing from the scope of the invention as set forth in the appended claims.

What is claimed is:

1. A device for controlling the speed of an engine having an accelerator, a carburetor with a throttle valve operatively connected to a rotatable throttle shaft and an accelerating pump for supplying additional fuel to the engine, and means for governing the speed of the engine, comprising;

connecting means for connecting the accelerator to the throttle shaft and the accelerating fuel pump, respectively, to operate the shaft and the pump separately responsive to the operation of the accelerator.

2. The device according to claim 1, wherein said connecting means includes an accelerator cable connecting to the accelerator, a throttle cable operatively connecting to the throttle shaft, a pump cable operatively connecting to the accelerating pump, and a slider connecting to an end of the accelerator cable at an input side thereof and to respective ends of the throttle cable and the pump cable at an output side thereof.

3. The device according to claim 2, wherein the accelerating pump cable is coupled to a swing arm pivotable responsive to pulling of the accelerating pump cable, the swing arm being connected to an adjusting rod of the accelerating pump through a motion transmitting mechanism.

4. The device according to claim 2, wherein the slider is connected to a throttle lever through the throttle cable, the throttle lever being coaxially and slidably mounted on the throttle shaft and coupled with the throttle shaft via resilient means.

* * * * *